US008445769B2

(12) United States Patent
Takahashi

(10) Patent No.: US 8,445,769 B2
(45) Date of Patent: May 21, 2013

(54) PERFORMANCE APPARATUS AND ELECTRONIC MUSICAL INSTRUMENT

(75) Inventor: Hiroki Takahashi, Ome (JP)

(73) Assignee: Casio Computer Co., Ltd, Tokyo (JP)

( * ) Notice: Subject to any disclaimer, the term of this patent is extended or adjusted under 35 U.S.C. 154(b) by 9 days.

(21) Appl. No.: 13/195,160

(22) Filed: Aug. 1, 2011

(65) Prior Publication Data

US 2012/0024128 A1 Feb. 2, 2012

(30) Foreign Application Priority Data

Aug. 2, 2010 (JP) ..... 2010-173266

(51) Int. Cl.
*G10H 1/02* (2006.01)

(52) U.S. Cl.
USPC ..... 84/737; 84/600; 84/622; 84/626; 84/723; 84/735; 84/741

(58) Field of Classification Search
None
See application file for complete search history.

(56) References Cited

U.S. PATENT DOCUMENTS

| | | | | |
|---|---|---|---|---|
| 5,058,480 | A | 10/1991 | Suzuki et al. | |
| 5,177,311 | A * | 1/1993 | Suzuki et al. | 84/600 |
| 5,290,964 | A * | 3/1994 | Hiyoshi et al. | 84/600 |
| 5,920,024 | A * | 7/1999 | Moore | 84/609 |
| 6,897,779 | B2 * | 5/2005 | Nishitani et al. | 340/573.1 |
| 7,135,637 | B2 * | 11/2006 | Nishitani et al. | 84/723 |
| 7,183,480 | B2 * | 2/2007 | Nishitani et al. | 84/615 |
| 7,294,777 | B2 * | 11/2007 | Hofmeister et al. | 84/615 |
| 7,781,666 | B2 * | 8/2010 | Nishitani et al. | 84/723 |
| 8,106,283 | B2 * | 1/2012 | Nishitani et al. | 84/612 |
| 8,198,526 | B2 * | 6/2012 | Izen et al. | 84/743 |
| 2001/0015123 | A1 * | 8/2001 | Nishitani et al. | 84/615 |
| 2003/0066413 | A1 * | 4/2003 | Nishitani et al. | 84/615 |
| 2003/0167908 | A1 * | 9/2003 | Nishitani et al. | 84/723 |
| 2006/0144212 | A1 * | 7/2006 | Hofmeister et al. | 84/724 |
| 2006/0185502 | A1 * | 8/2006 | Nishitani et al. | 84/615 |
| 2010/0263518 | A1 * | 10/2010 | Nishitani et al. | 84/612 |
| 2011/0290097 | A1 * | 12/2011 | Takahashi et al. | 84/622 |
| 2012/0006181 | A1 * | 1/2012 | Harada et al. | 84/600 |
| 2012/0152087 | A1 * | 6/2012 | Sakazaki | 84/600 |
| 2012/0216667 | A1 * | 8/2012 | Sakazaki | 84/725 |

FOREIGN PATENT DOCUMENTS

| | | | |
|---|---|---|---|
| JP | 2663503 | B2 | 6/1997 |
| JP | 2007-256736 | A | 10/2007 |

* cited by examiner

*Primary Examiner* — Marlon Fletcher
(74) *Attorney, Agent, or Firm* — Holtz, Holtz, Goodman & Chick, P.C.

(57) ABSTRACT

A performance apparatus 11 extends in its longitudinal direction to be held by a player with his or her hand, and is provided with an acceleration sensor 23 for detecting an acceleration sensor value and an angular rate sensor 22 for detecting an angular rate of rotation of the apparatus 11 about its longitudinal axis. CPU 21 detects a sound-generation timing based on the acceleration sensor value. Using the angular rate, CPU 21 calculates a rotation angle of the performance apparatus 11 made about its longitudinal axis in a period from a first and a second timing, wherein the first and second timing correspond to starting and finishing of swinging motion of the performance apparatus, respectively. CPU 21 determines to increase or decrease a sound volume level, in accordance with the direction and amount of the calculated rotation angle, thereby adjusting a sound volume level of musical tone.

10 Claims, 11 Drawing Sheets

PERFORMANCE APPARATUS AND ELECTRONIC MUSICAL INSTRUMENT

CROSS-REFERENCE TO RELATED APPLICATIONS

The present application is based upon and claims the benefit of priority from the prior Japanese Patent Application No. 2010-173266, file Aug. 2, 2010, and the entire contents of which are incorporated herein by reference.

BACKGROUND OF THE INVENTION

1. Field of the Invention

The present invention relates to a performance apparatus and an electronic musical instrument, which generate musical tones, when held and swung by a player with his or her hand.

2. Description of the Related Art

An electronic musical instrument has been proposed, which comprises an elongated member of a stick type with a sensor provided thereon, and generates a musical tone when the sensor detects a movement of the elongated member. Particularly, in the electronic musical instrument, the elongated member of a stick type has a shape of a drumstick and is constructed so as to generate musical tones as if percussion instruments generate sounds in response to player's motion of striking drums and/or Japanese drums.

For instance, U.S. Pat. No. 5,058,480 discloses a performance apparatus, which is provided with an acceleration sensor in its stick-type member, and generates a musical tone when a certain period of time has lapsed after an output (acceleration sensor value) from the acceleration sensor reaches a predetermined threshold value.

In the performance apparatus disclosed in U.S. Pat. No. 5,058,480, generation of musical tones is simply controlled based on the acceleration sensor values of the stick-type member and therefore, the performance apparatus has a drawback that it is not easy for a player to change musical tones as he or she desires.

Meanwhile, Japanese Patent No. 2007-256736 A discloses an apparatus, which is capable of generating musical tones having plural tone colors. The apparatus is provided with a geomagnetic sensor and detects an orientation of a stick-type member based on a sensor value obtained by the geomagnetic sensor. The apparatus selects one from among plural tone colors of a musical tone to be generated, based on the detected orientation of the stick-type member. In the apparatus disclosed in Japanese Patent No. 2007-256736 A, a tone color of musical tones has been decided based on the direction in which the stick-type member is swung by a player, that is, at the time when the stick-type member is swung by the player.

SUMMARY OF THE INVENTION

The present invention has an object to provide a performance apparatus and an electronic musical instrument, which allow a player to change musical tones as he or she desires, by his or her stick swinging motion in a certain period of time.

According to one aspect of the invention, there is provided a performance apparatus used with musical tone generating equipment, the apparatus which comprises a holding member extending in a longitudinal direction of the member to be held by a player with his or her hand, an acceleration sensor provided held within the holding member, for detecting an acceleration sensor value, an angular rate sensor provided held within the holding member, for detecting an angular rate sensor value of rotation of the holding member about an axis in the longitudinal direction of the holding member, and a controlling unit for obtaining a sound-generation timing based on the acceleration sensor value detected by the acceleration sensor and for giving the musical tone generating equipment an instruction of generating a musical tone, wherein the controlling unit comprises a sound-generation instructing unit for giving an instruction of generating a musical tone at the sound-generation timing obtained by the controlling unit, a first rotation angle calculating unit for calculating a rotation angle of the holding member about the axis in the longitudinal direction of the holding member, based on a variation of the angular rate sensor value during a period from a starting time when the player starts swinging down motion of the holding member to a finishing time when the player finishes the swinging down motion of the holding member, wherein the starting time and the finishing time are detected based on the acceleration sensor value, and a sound volume level calculating unit for calculating a sound volume level of a musical tone to be generated, based on the rotation angle of the holding member calculated by the first rotation angle calculating unit and for giving the calculated sound volume level of a musical tone to the sound-generation instructing unit.

According to another aspect of the invention, there is provided a performance apparatus used with musical tone generating equipment, the apparatus which comprises a holding member extending in a longitudinal direction of the member to be held by a player with his or her hand, an acceleration sensor provided held within the holding member, for detecting an acceleration sensor value, a tri-axial magnetic sensor provided held within the holding member, for detecting magnetic sensor values, respectively, along three axes, which are in accordance with the longitudinal direction of the holding member held by the player, wherein the three axes are perpendicular to each other, and a controlling unit for obtaining a sound-generation timing based on the acceleration sensor value detected by the acceleration sensor and for giving the musical tone generating equipment an instruction of generating a musical tone, wherein the controlling unit comprises a sound generation instructing unit for giving an instruction of generating a musical tone at the sound-generation timing obtained by the controlling unit, a second rotation angle calculating unit for calculating a rotation angle of the holding member about the axis in the longitudinal direction of the holding member, based on the magnetic sensor values obtained at a starting time when the player starts swinging down motion of the holding member and the magnetic sensor values obtained at a finishing time when the player finishes the swinging down motion of the holding member, wherein the starting time and the finishing time are detected based on the acceleration sensor value, and a sound volume level calculating unit for calculating a sound volume level of a musical tone to be generated, based on the rotation angle of the holding member calculated by the second rotation angle calculating unit, and for giving the calculated sound volume level of a musical tone to the sound generation instructing unit.

According to other aspect of the invention, there is provided an electronic musical instrument, which comprises a performance apparatus, and a musical instrument unit including a musical tone generating unit, wherein the performance apparatus and the musical instrument unit have a communication unit, and further the performance apparatus comprises a holding member extending in a longitudinal direction of the member to be held by a player with his or her hand, an acceleration sensor provided held within the holding member, for detecting an acceleration sensor value, an angular rate sensor provided held within the holding member, for detecting an angular rate sensor value of rotation of the holding member about an axis in the longitudinal direction of the holding member, and a controlling unit for obtaining a sound-generation timing based on the acceleration sensor value detected by the acceleration sensor and for giving an instruction of generating a musical tone to the musical tone generating unit of the musical instrument unit, wherein the controlling unit comprises a sound-generation instructing unit for giving an instruction of generating a musical tone at the sound-generation timing obtained by the controlling unit, a first rotation angle calculating unit for calculating a rotation angle of the holding member about the axis in the longitudinal direction of the holding member, based on a variation of the angular rate sensor value during a period from a starting time when the player starts swinging down motion of the holding member to a finishing time when the player finishes the swinging down motion of the holding member, wherein the starting time and the finishing time are detected based on the acceleration sensor value, and a sound volume level calculating unit for calculating a sound volume level of a musical tone to be generated, based on the rotation angle of the holding member calculated by the first rotation angle calculating unit and for giving the calculated sound volume level of a musical tone to the sound-generation instructing unit.

According to still other aspect of the invention, there is provided an electronic musical instrument, which comprises a performance apparatus and a musical instrument unit including a musical tone generating unit, wherein the performance apparatus and the musical instrument unit have a communication unit, and further the performance apparatus comprises, a holding member extending in a longitudinal direction of the member to be held by a player with his or her hand, an acceleration sensor provided held within the holding member, for detecting an acceleration sensor value, a tri-axial magnetic sensor provided held within the holding member, for detecting magnetic sensor values, respectively, along three axes, which are in accordance with the longitudinal direction of the holding member held by the player, wherein the three axes are perpendicular to each other, and a controlling unit for obtaining a sound-generation timing based on the acceleration sensor value detected by the acceleration sensor and for giving an instruction of generating a musical tone to the musical tone generating unit of the musical instrument unit, wherein the controlling unit comprises a sound-generation instructing unit for giving an instruction of generating a musical tone at the sound-generation timing obtained by the controlling unit, a second rotation angle calculating unit for calculating a rotation angle of the holding member about the axis in the longitudinal direction of the holding member based on the magnetic sensor values obtained at a starting time when the player starts swinging down motion of the holding member and the magnetic sensor values obtained at a finishing time when the player finishes the swinging down motion of the holding member, wherein the starting time and the finishing time are detected based on the acceleration sensor value, and a sound volume level calculating unit for calculating a sound volume level of a musical tone to be generated, based on the rotation angle of the holding member calculated by the second rotation angle calculating unit, and for giving the calculated sound volume level of a musical tone to the sound-generation instructing unit.

According to still other aspect of the invention, there is provided a performance apparatus used with tone generating equipment, the apparatus comprising: a holding member extending in a longitudinal direction of the member to be held by a player with his or her hand; an acceleration sensor provided held within the holding member, for detecting an acceleration sensor value; an angular rate sensor provided held within the holding member, for detecting an angular rate sensor value of rotation of the holding member about an axis in the longitudinal direction of the holding member; and a controlling unit for obtaining a sound-generation timing based on the acceleration sensor value detected by the acceleration sensor and for giving the tone generating equipment an instruction of generating a tone, wherein the controlling unit comprises: a sound-generation instructing unit for giving an instruction of generating a tone at the sound-generation timing obtained by the controlling unit; a first rotation angle calculating unit for calculating a rotation angle of the holding member about the axis in the longitudinal direction of the holding member, based on a variation of the angular rate sensor value during a period from a starting time when the player starts swinging down motion of the holding member to a finishing time when the player finishes the swinging down motion of the holding member, wherein the starting time and the finishing time are detected based on the acceleration sensor value; and a sound volume level calculating unit for calculating a sound volume level of a musical tone to be generated, based on the rotation angle of the holding member calculated by the first rotation angle calculating unit and for giving the calculated sound volume level of a tone to the sound-generation instructing unit.

According to still other aspect of the invention, there is provided a performance apparatus used with tone generating equipment, the apparatus comprising: a holding member extending in a longitudinal direction of the member to be held by a player with his or her hand; an acceleration sensor provided held within the holding member, for detecting an acceleration sensor value; a tri-axial magnetic sensor provided held within the holding member, for detecting magnetic sensor values, respectively, along three axes, which are in accordance with the longitudinal direction of the holding member held by the player, wherein the three axes are perpendicular to each other; and a controlling unit for obtaining a sound-generation timing based on the acceleration sensor value detected by the acceleration sensor and for giving the tone generating equipment an instruction of generating a tone, wherein the controlling unit comprises: a sound-generation instructing unit for giving an instruction of generating a musical tone at the sound-generation timing obtained by the controlling unit; a second rotation angle calculating unit for calculating a rotation angle of the holding member about the axis in the longitudinal direction of the holding member, based on the magnetic sensor values obtained at a starting time when the player starts swinging down motion of the holding member and the magnetic sensor values obtained at a finishing time when the player finishes the swinging down motion of the holding member, wherein the starting time and the finishing time are detected based on the acceleration sensor value; and a sound volume level calculating unit for calculating a sound volume level of a tone to be generated, based on the rotation angle of the holding member calculated by the second rotation angle calculating unit, and for giving the calculated sound volume level of a tone to the sound-generation instructing unit.

DETAILED DESCRIPTION OF THE PREFERRED EMBODIMENTS

Figure 1:
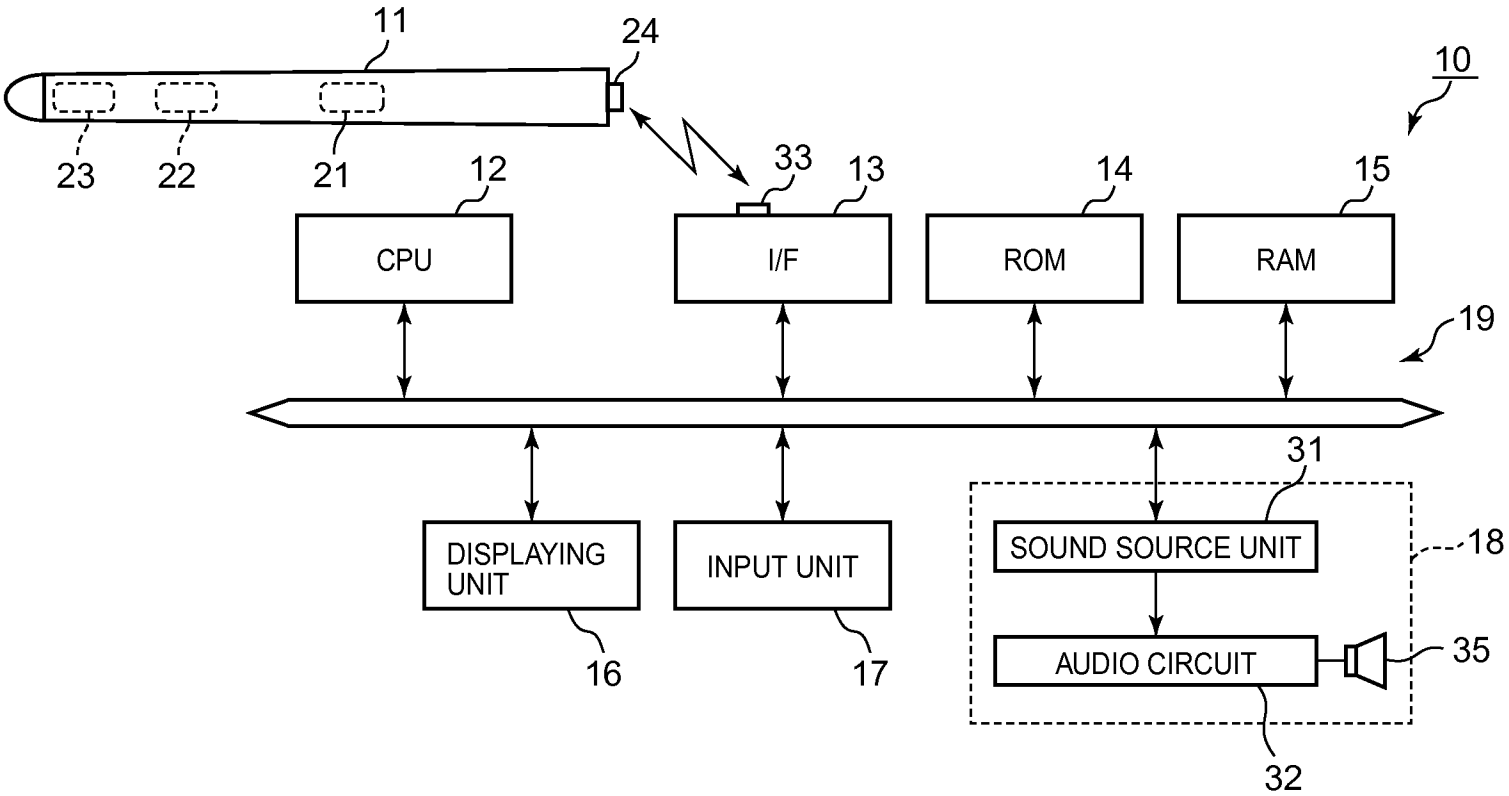
FIG. 1 is a block diagram of a configuration of an electronic musical instrument according to the first embodiment of the invention.

Now, embodiments of the present invention will be described with reference to the accompanying drawings in detail. FIG. 1 is a block diagram of a configuration of an electronic musical instrument according to the first embodiment of the invention. As shown in FIG. 1, the electronic musical instrument 10 according to the first embodiment has a stick-type performance apparatus 11, which extends in its longitudinal direction to be held or gripped by a player with his or her hand. The performance apparatus 11 is held or ripped by the player to be swung. The electronic musical instrument 10 is provided with a musical instrument unit 19 for generating musical tones. The musical instrument unit 19 comprises CPU 12, an interface (I/F) 13, ROM 14, RAM 15, a displaying unit 16, an input unit 17 and a sound system 18. As will be described in detail later, the performance apparatus 11 is equipped with an acceleration sensor 23 and an angular rate sensor 22 around on a head portion opposite to a base portion of the elongated performance apparatus 11. The player grips or holds the base portion to swing the elongated performance apparatus 11.

The I/F 13 of the musical instrument unit 19 serves to receive data (for instance, a note-on event) from the performance apparatus 11. The data received through I/F 13 is stored in RAM 15 and notice of receipt of such data is given to CPU 12. In the present embodiment, the performance apparatus 11 is equipped with an infrared communication device 24 at the edge of the base portion (Refer to Reference numeral: 211 in FIG. 2) and I/F 13 of the musical instrument unit 19 is also equipped with an infrared communication device 33. The infrared communication device 33 of I/F 13 receives infrared light generated by the infrared communication device 24 of the performance device 11, whereby the musical instrument unit 19 can receive data from the performance apparatus 11.

CPU 12 controls whole operation of the electronic musical instrument 10. In particular, CPU 12 serves to perform various processes including a controlling operation of the musical instrument unit 19, a detecting operation of a manipulated state of key switches (not shown) in the input unit 17 and a generating operation of musical tones based on note-on events received through I/F 13.

ROM 14 stores programs for executing various processes, including a process for controlling the whole operation of the electronic musical instrument 10, a process for controlling the operation of the musical instrument unit 19, a process for detecting the operated state of the key switches (not shown) in the input unit 17, and a process for generating musical tones based on note-on events received through I/F 13. ROM 14 has a waveform-data area for storing waveform data of various tone colors, in particular, including waveform data of percussion instruments such as bass drums, high-hats, snare drums and cymbals. The waveform data to be stored in ROM 14 is not limited to the waveform data of the percussion instruments, but waveform data of wind instruments such as flutes, saxes and trumpets, waveform data of keyboard instruments such as pianos, and waveform data of string instruments such as guitars may be stored in ROM 14.

RAM 15 serves to store programs read from ROM 14 and to store data and parameters generated during the course of the executed process. The data generated in the process includes the manipulated state of the switches in the input unit 17 and note-on events and generated states of sounds received through I/F 13.

The displaying unit 16 has, for example, a liquid crystal displaying device (not shown) and is able to display a selected tone color. The input unit 17 includes various switches (not shown), which are used to designate a tone color.

The sound system 18 comprises a sound source unit 31, an audio circuit 32 and a speaker 35. Upon receipt of an instruction from CPU 12, the sound source unit 31 reads waveform data from the waveform-data area of ROM 14 to generate and output musical tone data. The audio circuit 32 converts the musical tone data supplied from the sound source unit 31 into an analog signal and amplifies the analog signal to output the amplified signal from the speaker 35, whereby a musical tone is output from the speaker 35.

Figure 2:
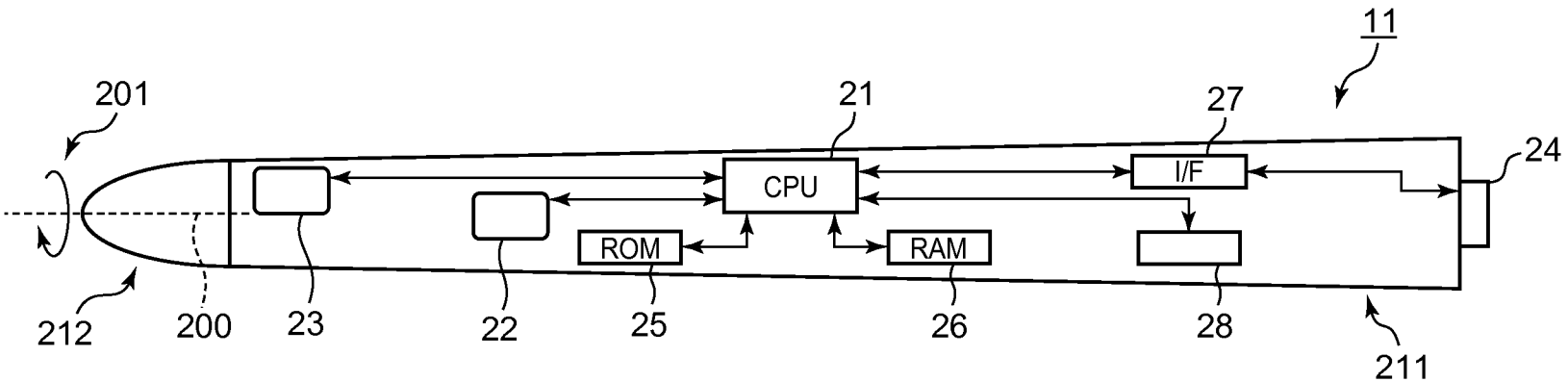
FIG. 2 is a block diagram of a configuration of a performance apparatus in the first embodiment of the invention.

FIG. 2 is a block diagram of a configuration of the performance apparatus 11 in the first embodiment of the invention. As shown in FIG. 2, the performance apparatus 11 is equipped with the angular rate sensor 22 and the acceleration sensor 23 on the head portion (Reference numeral: 212) opposite to the base portion (Reference numeral: 211). The based portion 211 is a portion where the player holds or grips to swing the performance apparatus 11. The portion where the angular rate sensor 22 to be mounted on is not limited to the head portion, but the angular rate sensor 22 may be mounted on the base portion. The angular rate sensor 22 is provided with a gyroscope and is able to detect an angular rate of rotation (Reference numeral: 201) of the performance apparatus 11 about an axis (Reference numeral: 200) in the longitudinal direction of the performance apparatus 11. The acceleration sensor 23 is a sensor, for example, of a capacitance type and/or of a piezoresistive type. The acceleration sensor 23 is able to output a data value representing acceleration. The acceleration sensor 23 in the present embodiment outputs an acceleration sensor value along the longitudinal axis (Reference numeral: 200) of the performance apparatus 11.

When the player actually plays the drum, he or she holds one end (base portion 211) of the stick (performance apparatus 11) and rotates the stick around a center at his or her wrist. In the present embodiment, an acceleration sensor value in the direction of the axis 200 of the performance apparatus 11 is obtained to detect a centrifugal force caused by the rotating motion of the stick. In this case, a tri-axial sensor can be used as the acceleration sensor. Further in the present embodiment, a displacement (rotation angle) of the performance apparatus 11 around the axis 200 can be obtained by the angular rate sensor 22.

Figure 3:
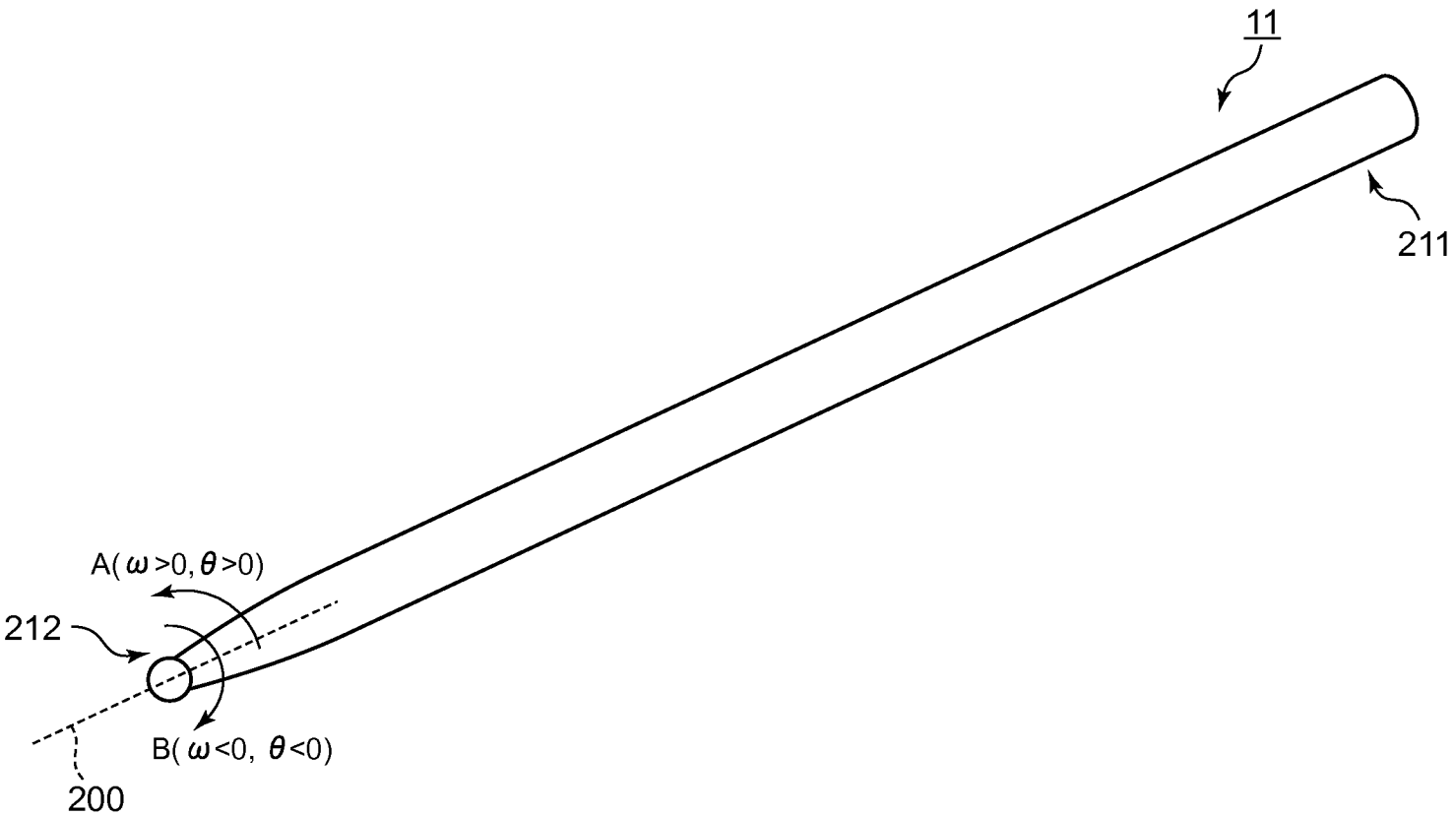
FIG. 3 is a perspective view showing an external appearance of the performance apparatus in the first embodiment of the invention.

FIG. 3 is a perspective view showing an external appearance of the performance apparatus 11 according to the first embodiment of the invention. In FIG. 3, the performance apparatus 11 is drawn with its base portion (Reference numeral: 211) in the back and its head portion (Reference numeral: 212) in the front. In FIG. 3, it is assumed that an angular rate ω in the counter clockwise direction (seen from the head portion 212, and indicated by an arrow "A") is positive, and meanwhile, an angular rate ω in the clockwise direction (seen from the head portion 212, and indicated by an arrow "B") is negative. In the following description, the direction of rotation of the performance apparatus 11 around the axis 200 indicates the rotational direction seen from the head portion 212 of the performance apparatus 11. This definition is given to make clear the rotational direction around the axis throughout the description. Similarly, it is assumed that the displacement (rotation angle) θ around the axis 200 of the performance apparatus 11 in the counter clockwise direction (seen from the head portion 212, and indicated by the arrow "A") is positive, and meanwhile the displacement (rotation angle) θ around the axis 200 of the performance apparatus 11 in the clockwise direction (seen from the head portion 212, and indicated by the arrow "B") is negative. The present embodiment is arranged that when the displacement (rotational angle) around the axis 200 is set positive, a sound volume level will increase and when the displacement (rotational angle) around the axis 200 is set negative, a sound volume level will decrease.

The performance apparatus 11 comprises CPU 21, the infrared communication device 24, ROM 25, RAM 26, an interface (I/F) 27 and an input unit 28. CPU 21 performs various processes including an obtaining operation of an acceleration sensor value and an angular rate sensor value of the performance apparatus 11, a detecting operation of a sound-generation timing of a musical tone in accordance with the acceleration-sensor value, a producing operation of a note-on event, a calculating operation of a sound volume level adjustment based on the angular rate sensor value, and a controlling operation of a sending operation of the note-on event through I/F 27 and the infrared communication device 24.

ROM 25 stores various process programs for obtaining an acceleration sensor value and an angular rate sensor value in the performance apparatus 11, detecting a sound-generation timings of a musical tone in accordance with the acceleration-sensor value, producing a note-on event, calculating a sound-volume level adjustment based on the angular rate sensor value, and controlling of sending operation of the note-on event through I/F 27 and the infrared communication device 24. RAM 26 stores values produced and/or obtained in the process such as the acceleration-sensor value. In accordance with an instruction from CPU 21, data is supplied to the infrared communication device 24 through I/F 27. The input unit 28 includes various switches (not shown).

Figure 4:
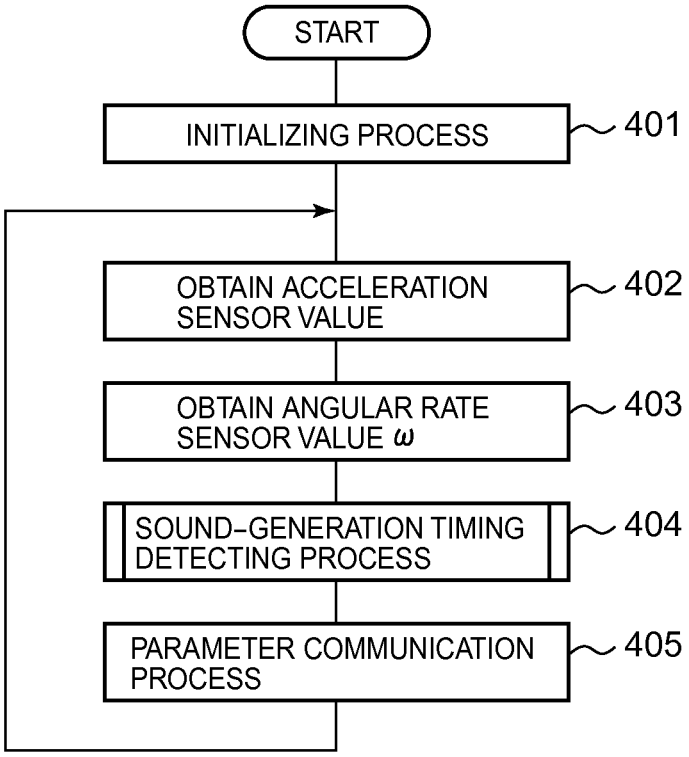
FIG. 4 is a flow chart of an example of a process performed in the performance apparatus according to the first embodiment of the invention.

FIG. 4 is a flow chart of an example of a process performed in the performance apparatus 11 according to the first embodiment of the invention. CPU 21 of the performance apparatus 11 performs an initializing process at step 401, clearing data in RAM 26. After performing the initializing process at step 401, CPU 21 obtains a sensor value of the acceleration sensor 23 and stores the obtained sensor value in RAM 26 at step 402. As described above, the sensor value in the axial direction of the performance apparatus 11 is used as the acceleration sensor value in the present embodiment. Further, CPU 21 obtains a sensor value (angular rate sensor value ω) from the angular rate sensor 22 and stores the obtained sensor value in RAM 26 at step 403.

Figure 5:
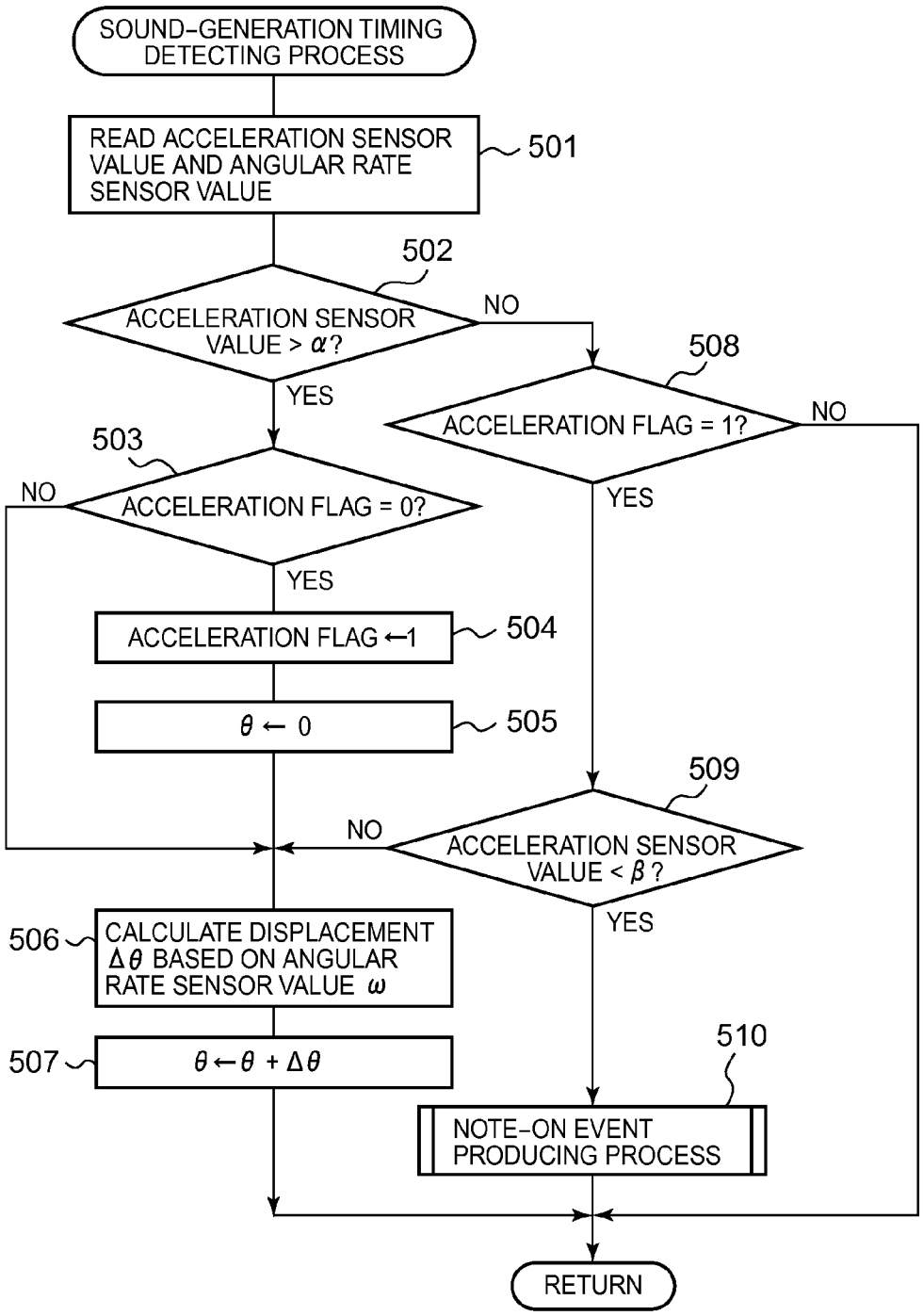
FIG. 5 is a flow chart of an example of a sound-generation timing detecting process performed in the performance apparatus according to the first embodiment of the invention.

Then, CPU 21 performs a sound-generation timing detecting process at step 404. FIG. 5 is a flow chart showing an example of the sound-generation timing detecting process performed in the performance apparatus 11 according to the first embodiment of the invention. CPU 21 reads the acceleration sensor value and the angular rate sensor value ω from RAM 26 at step 501. CPU 21 judges at step 502 whether or not the acceleration sensor value is larger than a first threshold value α. When it is determined YES at step 502, CPU 21 judges at step 503 whether or not an acceleration flag in RAM 26 has been set to "0". When it is determined YES at step 503, CPU 21 sets "1" to the acceleration flag in RAM 26 (step 504). And then, CPU 21 initializes the rotation angle θ of the performance apparatus 11 to "0" (step 505).

CPU 21 calculates a displacement Δθ around the axis based on the angular rate sensor value ω (step 506). It is possible to calculate the displacement Δθ using the angular rate sensor value ω and a time difference between the time at which the previous displacement Δθ was calculated and the time at which the current displacement Δθ is calculated. CPU 21 adds the displacement Δθ calculated at step 505 to the rotation angle θ (step 507). As described above, in the case the rotation is in counter clockwise direction (seen from the head portion 212, indicated by the arrow "A" in FIG. 2), the displacement Δθ is positive, and in the case the rotation is in clockwise direction (seen from the head portion 212, indicated by the arrow "B" in FIG. 2), the displacement Δθ is negative.

When it is determined at step 502 that the acceleration sensor value is not larger than the first threshold value α (NO at step 502), CPU 21 judges at step 508 whether or not the acceleration flag in RAM 26 has been set to "1". When it is determined NO at step 508, then the sound-generation timing detecting process terminates. When it is determined YES at step 508, CPU 21 judges at step 509 whether or not the acceleration sensor value is lower than a second threshold value β. When it is determined NO at step 509, CPU 21 advances to step 506. When it is determined YES at step 509, CPU 21 performs a note-on event producing process at step 510.

Figure 6:
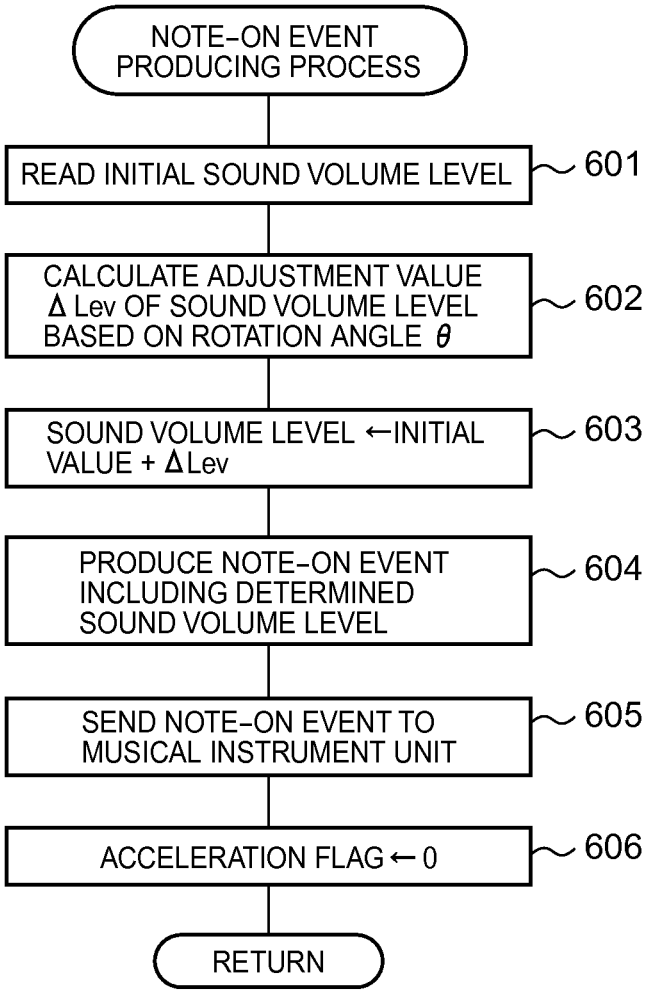
FIG. 6 is a flow chart of an example of a note-on event producing process performed in the performance apparatus according to the first embodiment of the invention.

FIG. 6 is a flow chart of an example of the note-on event producing process performed in the performance apparatus 11 according to the present embodiment. In the note-on event producing process shown in FIG. 6, a note-on event is sent from the performance apparatus 11 to the musical instrument unit 19, and then a sound generating process (step 704 in FIG. 7) is performed in the musical instrument unit 19, whereby musical tone data is generated and a musical tone is output from the speaker 35.

Figure 8:
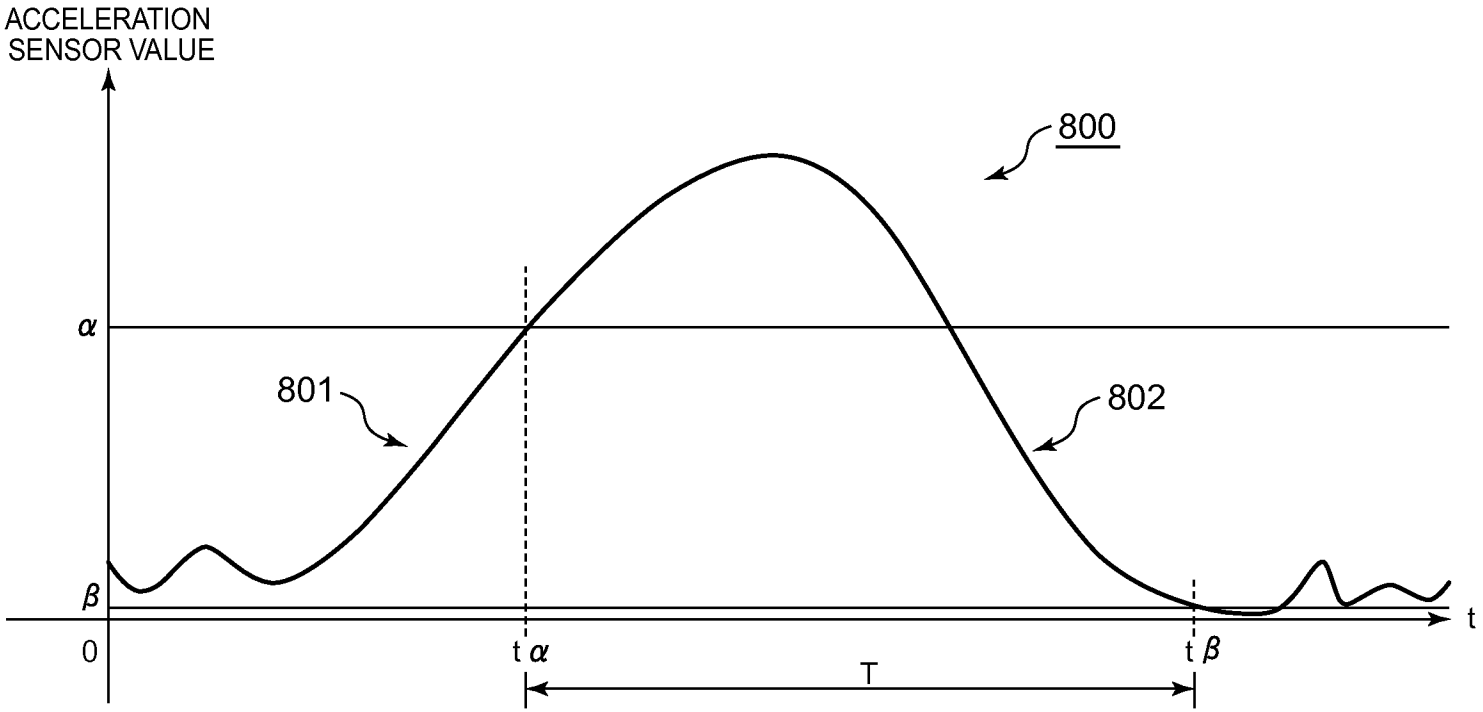
FIG. 8 is a view of a graph that typically represents an example of an acceleration sensor value detected by an acceleration sensor in the performance apparatus.

Before describing the note-on event producing process, the sound-generation timing in the electronic musical instrument 10 of the present embodiment will be described. FIG. 8 is a view of a graph that typically represents an example of the acceleration sensor value detected by the acceleration sensor 23 of the performance apparatus 11. When the player holds one end (base portion) of the performance apparatus 11 and swings the same, the performance apparatus 11 will rotate about the fulcrum at the player's wrist, elbow, and/or shoulder. The rotary movement of the performance apparatus 11, in particular, centrifugal force will cause acceleration in the axial direction of the performance apparatus 11.

When the player swings the performance apparatus 11, the acceleration sensor value will increase gradually (Refer to a curve 800 and Reference numeral: 801 in FIG. 8). When the player swings the performance apparatus 11 of a stick type, in general he or she moves his or her arm just like he or she plays the drum. Therefore, the player stops the stick (performance apparatus 11 of a stick type) just before actually striking an imaginary surface of the drum. Accordingly, the acceleration sensor value will begin decreasing gradually from one time (Reference numeral: 802). The player assumes that a musical tone is generated at the time when he or she strikes the imaginary surface of the drum. And therefore, it is preferable that a musical tone is generated at the time that the player assumes.

The present embodiment of the invention employs the following logic to generate a musical tone at the moment when the player strikes the imaginary surface of the drum or just before such moment. In the present embodiment, it is assumed that the musical tone is generated at the time when the acceleration sensor value has decreased lower than the second threshold value $\beta$, wherein the second threshold value $\beta$ is slightly larger than "0". But the acceleration sensor value can wobble to reach close to the second threshold value $\beta$ due to unintentional motion of the player. Therefore, to remove the above drawback due to the wobble of the acceleration sensor value, the condition that the acceleration sensor value has once increased larger than the first threshold value is set for generation of the musical tone, wherein the first threshold value $\alpha$ is sufficiently larger than the second threshold value $\beta$. That is, the sound-generation timing or the time at which a musical tone is generated is set at the time $t\beta$ when the acceleration sensor value has decreased lower than the second threshold value $\beta$ after once increasing larger than the first threshold value $\alpha$. When it is determined that the sound-generation timing has been reached, a note-on event is produced in the performance apparatus 11 and sent to the musical instrument unit 19. Receiving the note-on event, the musical instrument unit 19 performs a sound generating process and a sound source process, thereby generating a musical tone.

In the present embodiment of the invention, a sound volume level of a musical tone to be generated is adjusted based on the rotation angle $\theta$ of the performance apparatus 11 about the axis 200 made during a period "T" between the time $t\alpha$ when the acceleration sensor value has increased larger than the first threshold value $\alpha$ and the time $t\beta$ when the acceleration sensor value has decreased lower than the second threshold value $\beta$.

In the note-on event producing process of FIG. 6, CPU 21 reads an initial sound volume level from RAM 26 (step 601). Then, CPU 21 calculates an adjustment value $\Delta Lev$ of sound volume based on the rotation angle $\theta$ stored in RAM 26 (step 602).

For example, the adjustment value $\Delta Lev$ can be calculated as follows:

$\Delta Lev = b \cdot \theta$, where "b" is a positive coefficient.

If the rotation angle $\theta$ is positive, then $\Delta Lev$ will be positive, and if the rotation angle $\theta$ is negative, then $\Delta Lev$ will be positive. CPU 21 adds the calculated adjustment value $\Delta Lev$ to the initial sound volume level, obtaining a sound volume level Vel (step 603). If the initial sound volume level+ $\Delta Lev \geqq Vmax$, where Vmax is the maximum sound volume level, the sound volume level will be Vmax. The sound volume level will increase or decrease depending on the rotation angle $\theta$ of the performance apparatus 11 about its axis 200.

CPU 21 produces a note-on event containing information representing the calculated sound volume level (velocity) and a pitch (step 604). It is possible to contain in the note-on event a predetermined value as information representing a pitch.

CPU 21 sends the produced note-on event to I/F 27 at step 605. I/F 27 makes the infrared communication device 24 send an infrared signal of the note-on event. The infrared signal is transferred from the infrared communication device 24 to the infrared communication device 33 of the musical instrument unit 19. Thereafter, CPU 21 resets the acceleration flag in RAM 26 to "0" at step 606.

When the sound-generation timing detecting process finishes at step 404 in FIG. 4, CPU 21 performs a parameter communication process at step 405. The parameter communication process (step 405) will be described together with a parameter communication process to be performed in the musical instrument unit 19 (step 705 in FIG. 7).

Figure 7:
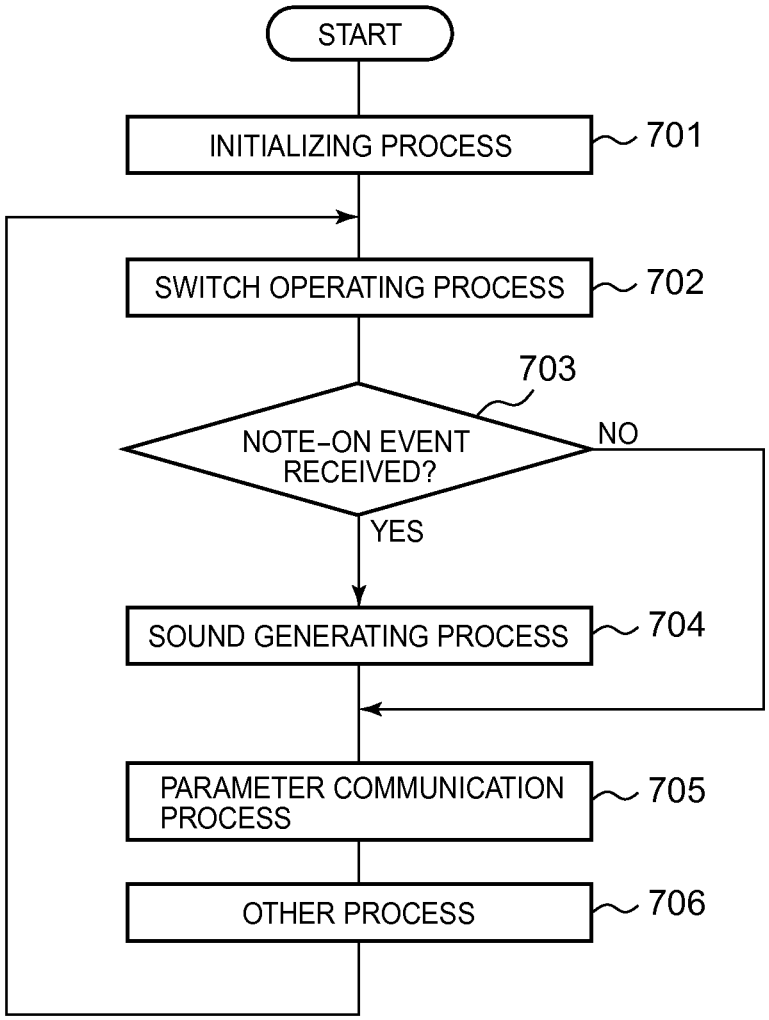
FIG. 7 is a flow chart of an example of a process performed in a musical instrument unit according to the first embodiment of the invention.

The process to be performed in the musical instrument unit 19 according to the first embodiment will be described with reference to a flow chart of FIG. 7. The flow chart of FIG. 7 shows an example of the process performed in the musical instrument unit 19 in the first embodiment. CPU 12 of the musical instrument unit 19 performs an initializing process at step 701, clearing data in RAM 15 and an image on the display screen of the displaying unit 16 and further clearing the sound source 31. Then, CPU 12 performs a switch operating process at step 702. In the switch operating process, for example, the following process is performed. CPU 12 sets a tone color of musical tone to be generated, in response to the switch operation of the input unit 17 by the player. CPU 12 stores in RAM 15 information of the designated tone color.

Then, CPU 12 judges at step 703 whether or not any note-on event has been received through I/F 13. When it is determined at step 703 that a note-on event has been received through I/F 13 (YES at 703), CPU 12 performs the sound generating process at step 704. In the sound generating process, CPU 12 sends the sound source unit 31 the note-on event, which is received through I/F 13 and stored in RAM 15, giving the sound source 31 an instruction of generating a sound.

Upon receipt of the note-on event, the sound source unit 31 reads waveform data from ROM 14 in accordance with the tone color represented by the received note-on event. The waveform data is read at a rate corresponding to the pitch included in the note-on event. The sound source unit 31 multiplies the waveform data by the sound volume level (velocity) contained in the note-on event, producing musical tone data of a predetermined sound volume level. The produced musical tone data is supplied to the audio circuit 32, and a musical tone of the predetermined sound volume level is output through the speaker 35.

After the sound generating process has finished (step 704), CPU 12 performs a parameter communication process at step 705. In the parameter communication process, CPU 12 gives an instruction to the infrared communication device 33, and the infrared communication device 33 sends the tone color of a musical tone to be generated to the performance apparatus 11 through I/F 13. In the performance apparatus 11, when the infrared communication device 24 receives the data, CPU 21 receives the data through I/F 27 and stores the data in RAM 26 (step 405 in FIG. 4).

When the parameter communication process has finished at step 705 in FIG. 7, CPU 12 performs other process at step 706. For instance, CPU 12 updates an image on the display screen of the displaying unit 16.

In the present embodiment, the angular rate sensor value $\omega$ is used to obtain the rotation angle of the performance apparatus 11 made about the axis 200 in the period between the first timing and the second timing, wherein the first timing corresponds to the time at which the player starts swinging motion of the performance apparatus 11 and the second timing corresponds to the time at which the player finishes the swinging motion of the performance apparatus 11. In accordance with the rotation angle obtained based on the angular rate sensor value ω, CPU 21 of the performance apparatus 11 calculates the direction of the rotation of the performance apparatus 11 and the amount of the rotation, and further calculates a variation of the sound volume level and an adjustment value of the variation based on the calculated values (the direction of the rotation and the amount of the rotation) to adjust the sound volume level. Using the performance apparatus 11 according to the present embodiment, the player is allowed to generate a musical tone having a sound volume level as his or her desired, by twisting his or her wrist.

In the performance apparatus 11 according to the present embodiment, when the rotation angle θ of the performance apparatus 11 about its axis 200 shows one direction (for instance, as indicated by the arrow "A" in FIG. 3), CPU 21 increases the sound volume level, and on the contrary, when the rotation angle θ of the performance apparatus 11 about its axis 200 shows other direction (for instance, as indicated by the arrow "B" in FIG. 3), CPU 21 decreases the sound volume level. Accordingly, the player is allowed to increase or decrease the sound volume level of a musical tone to be generated, by choosing the direction of the rotation of his or her wrist.

In the present embodiment, in the case that the rotation of the performance apparatus 11 is in one direction, CPU 21 calculates the sound volume level such that an increasing value from a predetermined reference value will increase, as the absolute value of the rotation angle increases, and in the case that the rotation of the performance apparatus 11 is in other direction, CPU 21 calculates the sound volume level such that a decreasing value from the predetermined reference value will increase, as the absolute value of the rotation angle increases. Based on the above rotation of the performance apparatus 11, the player is allowed to adjust the sound volume level of a musical tone to be generated, depending on how much he or she twists or turns his or her wrist.

In the present embodiment, CPU 21 sets the sound generating timing at the time when the acceleration sensor value of the acceleration sensor 23 has decreased smaller than the second threshold value β after increasing larger than the first threshold value α, and produces the note-on event at the sound generating timing, wherein the second threshold value β is smaller than the first threshold value α, and gives the musical instrument unit 19 an instruction of generating a musical tone. Accordingly, it is possible to generate a musical tone at the moment when the player strikes the imaginary surface of the drum.

In the present embodiment, the displacement (rotation angle) of the performance apparatus 11 is obtained, which is made during the period required by the acceleration sensor value to decrease to the second threshold value β after reaching the first threshold value α, and the sound volume level of a musical tone to be generated is adjusted based on the obtained the displacement (rotation angle) of the performance apparatus 11. Accordingly, the player is allowed to adjust the sound volume level of a musical tone to be generated by twisting or rotating his or her wrist during the period from the starting of swinging motion of the performance apparatus 11 to finishing of the swinging motion of the performance apparatus 11.

Now, the second embodiment of the invention will be described. In the first embodiment, the performance apparatus 11 is provided with the angular rate sensor 22, and the rotation angle of the performance apparatus 11 about the axis 200 is calculated using the angular rate sensor value ω obtained by the angular rate sensor 22. Meanwhile, in the second embodiment, the performance apparatus 11 is provided with a tri-axial (three-dimensional) magnetic sensor in place of the angular rate sensor 22.

In FIG. 2, it is possible to mount the tri-axial (three-dimensional) magnetic sensor on the performance apparatus 11 substantially at the same position as the acceleration sensor. The tri-axial (three-dimensional) magnetic sensor can be mounted on the performance apparatus 11 close to the base portion 211 instead of close to the head portion 212. Assuming that Y-axis is set in the direction of the axis 200 of the performance apparatus 11, and X-axis is set perpendicular to the Y-axis and in parallel with a circuit board, on which the tri-axial magnetic sensor is mounted, and Z-axis is perpendicular to the X-axis and the Y-axis, then the tri-axial magnetic sensor is able to obtain magnetic sensor values (X, Y, Z) respectively along the X-axis, Y-axis and Z-axis.

Figure 9:
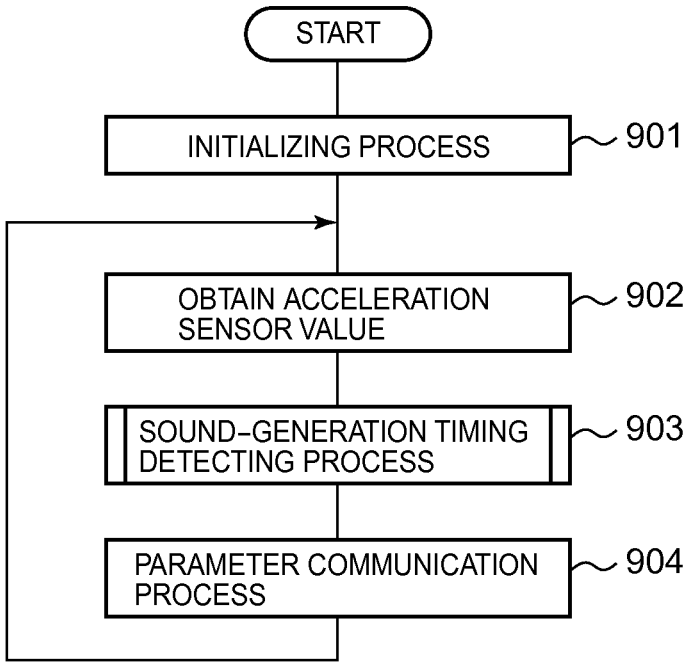
FIG. 9 is a flow chart of an example of a process performed in the performance apparatus according to the second embodiment of the invention.
Figure 10:
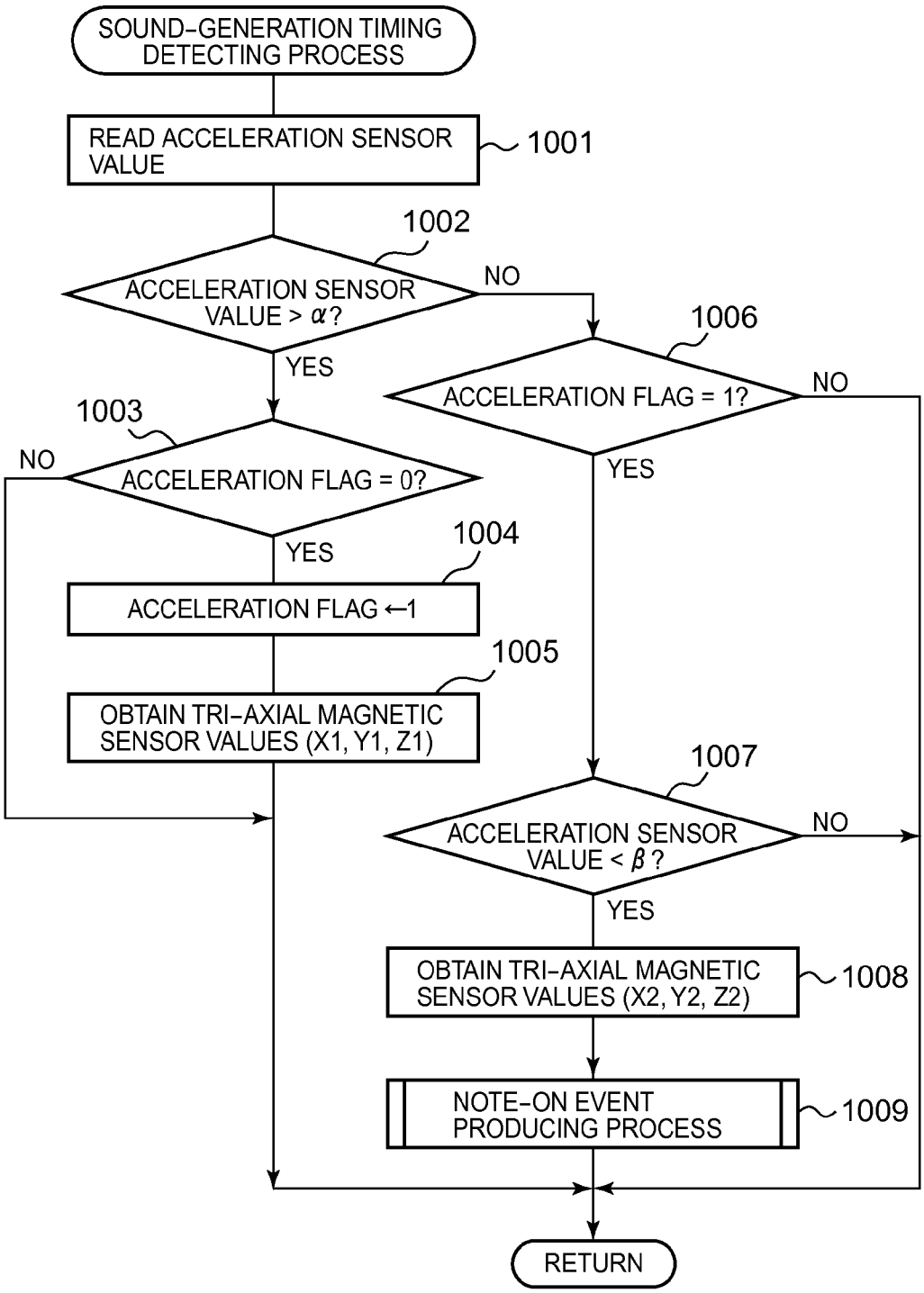
FIG. 10 is a flow chart of an example of a sound-generation timing detecting process performed in the performance apparatus according to the second embodiment of the invention.

FIG. 9 is a flow chart of an example of a process to be performed in the performance apparatus 11 according to the second embodiment. In FIG. 9, processes at step 901 and step 902 are substantially the same as those at step 401 and step 402. CPU 21 of the performance apparatus 11 performs the sound-generation timing detecting process at step 903. FIG. 10 is a flow chart of an example of the sound-generation timing detecting process performed in the performance apparatus 11 according to the second embodiment.

CPU 21 of the performance apparatus 11 reads the acceleration sensor value from RAM 26 (step 1001). CPU 21 judges whether or not the acceleration sensor value is larger than the first threshold value α (step 1002). When it is determined YES at step 1002, CPU 21 judges whether or not the acceleration flag in RAM 26 has been set to "0" (step 1003). When it is determined YES at step 1003, CPU 21 sets the acceleration flag in RAM 26 to "1". CPU 21 obtains tri-axial magnetic sensor values (first tri-axial magnetic sensor values, X1, Y1, Z1) from the tri-axial magnetic sensor and stores these sensor values in RAM 26 (step 1005). When it is determined NO at step 1003, the sound-generation timing detecting process finishes.

When it is determined at step 1002 that the acceleration sensor value is not larger than the first threshold value α (NO at step 1002), CPU 21 judges whether or not the acceleration flag has been set to "1" (step 1006). When it is determined NO at step 1006, the sound-generation timing detecting process finishes. When it is determined YES at step 1006, CPU 21 judges whether or not the acceleration sensor value is lower than the second threshold value β (step 1007). When it is determined NO at step 1007, the sound-generation timing detecting process finishes.

When it is determined at step 1007 that the acceleration sensor value is lower than the second threshold value β (YES at step 1007), CPU 21 obtains tri-axial magnetic sensor values (second tri-axial magnetic sensor values, X2, Y2, Z2) from the tri-axial magnetic sensor and stores these sensor values in RAM 26 (step 1008). Then, CPU 21 performs the note-on event producing process at step 1009.

Figure 11:
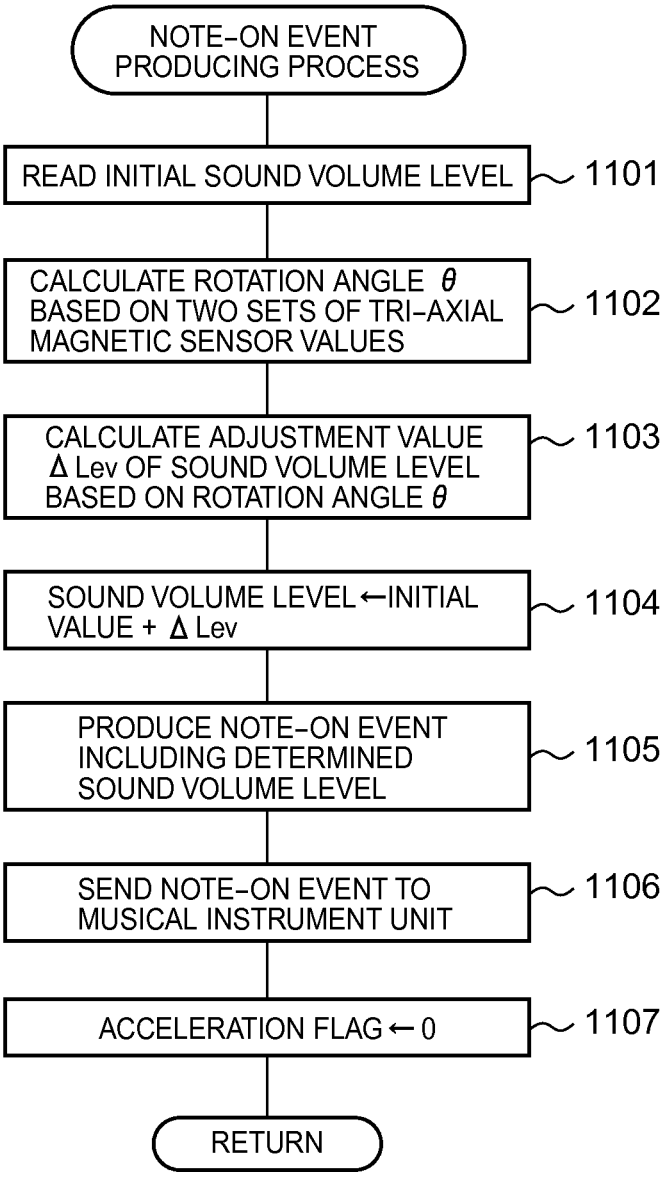
FIG. 11 is a flow chart of an example of the note-on event producing process performed in the second embodiment of the invention.

FIG. 11 is a flow chart showing an example of the note-on event producing process performed in the second embodiment of the invention. CPU 21 of the performance apparatus 11 reads the initial sound volume level from RAM 26 (step 1101). Further, CPU 21 reads the first tri-axial magnetic sensor values X1, Y1, Z1 and the second tri-axial magnetic sensor values X2, Y2, Z2 from RAM 26, and calculates a rotation angle of the performance apparatus 11 about the axis 200 using these two sets of tri-axial magnetic sensor values (step 1102).

Assuming that the vector indicating the magnetic north (the direction in which the north end of a compass needle will point) is divided into components respectively along the X-axis, Y-axis, and Z-axis, the tri-axial magnetic sensor value is obtained, which is divided into three components (X, Y, Z) respectively along the X-axis, Y-axis, and Z-axis. These components of the tri-axial magnetic sensor value will vary with the direction, in which the performance apparatus 11 is held by the player. CPU 21 calculates a rotation angle θ of the performance apparatus 11 about the axis 200 (Y-axis) made during a period for the first time when the first tri-axial magnetic sensor values X1, Y1, Z1 are obtained to the time when the second tri-axial magnetic sensor values X2, Y2, Z2 are obtained. Processes at step 1103 to step 1107 are substantially the same as those at step 602 to step 606 in FIG. 6. Then, an adjustment value ΔLev of sound volume level is calculated based on the rotation angle θ of the performance apparatus 11 (step 1103), and a sound volume level Vel is adjusted based on the adjustment value ΔLev (step 1104). A note-on event containing the sound volume level Vel is produced and sent to the musical instrument unit 19 (steps 1105, 1106).

In the second embodiment of the invention, the rotation angle θ of the performance apparatus 11 about the axis 200 made during the period from the first timing to the second timing is calculated based on the tri-axial magnetic sensor values, wherein the first timing corresponds to the time when the player starts swinging motion of the performance apparatus 11 and the second timing corresponds to the time when the player finishes the swinging motion of the performance apparatus 11. CPU 21 of the performance apparatus 11 calculates the direction and angle of the rotation of the performance apparatus 11 in accordance with the rotation angle obtained based on the magnetic sensor values, and further calculates the variation of the sound volume level and the adjustment value to the variation using the calculated direction and angle of the rotation of the performance apparatus 11, adjusting the sound volume level. In the present embodiment, the performance apparatus 11 allows the player to determine a sound volume level of a musical tone, as his or her desired by twisting his or her wrist.

The present invention has been described with reference to the accompanying drawings and the first and second embodiments, but it will be understood that the invention is not limited to these particular embodiments described herein, and numerous arrangements, modifications, and substitutions may be made to the embodiments of the invention described herein without departing from the scope of the invention.

In the embodiments, CPU 21 of the performance apparatus 11 detects an acceleration sensor value caused when the player swings the performance apparatus 11, and determines the timing of sound generation. Then, CPU 21 of the performance apparatus 11 produces a note-on event at the timing of sound generation, and transmits the note-on event to the musical instrument unit 19 through I/F 27 and the infrared communication device 24. Meanwhile, receiving the note-on event, CPU 12 of the musical instrument unit 19 supplies the received note-on event to the sound source unit 31, thereby generating a musical tone. The above arrangement is preferably used in the case that the musical instrument unit 19 is a device not specialized in generating musical tones, such as a personal computer and/or a game machine provided with a MIDI board.

The processes to be performed in the performance apparatus 11 and the processes to be performed in the musical instrument unit 19 are not limited to those described in the above embodiments.

For example, an arrangement may be made such that the performance apparatus 11 obtains acceleration sensor values, angular sensor values, and/or tri-axial magnetic sensor values and sends these values to the musical instrument unit 19. In the arrangement, the sound-generation timing detecting process (FIG. 5) and the note-on event producing process (FIG. 6) are performed in the musical instrument unit 19. The arrangement is suitable for use in electronic musical instruments, in which the musical instrument unit 19 is used as a device specialized in generating musical tones.

Further, in the embodiments, the infrared communication devices 24 and 33 are used for an infrared signal communication between the performance apparatus 11 and the musical instrument unit 19 to exchange data between them, but the invention is not limited to the infrared signal communication. For example, data may be exchanged between percussion instruments 11 and the musical instrument unit 19 by means of radio communication and/or wire communication in place of the infrared signal communication through the devices 24 and 33.

In the present embodiment, CPU 21 of the performance apparatus 11 sets the sound-generation timing at the time when the acceleration sensor value has decreased smaller than the second threshold value β after increasing larger than the first threshold value α, wherein the second threshold value β is smaller than the first threshold value α, and gives the musical instrument unit 19 an instruction of generating a musical tone. The sound-generation timing is not limited to the above time, but the sound-generation timing may be set to the time when the acceleration sensor value has reached the maximum or the time when a certain period of time has lapsed after the acceleration sensor value reaches the maximum. In the embodiments, the rotation angle made in the period defined by two timings is calculated, but this period may be defined by other acceleration sensor values.

What is claimed is:

1. A performance apparatus used with musical tone generating equipment, the apparatus comprising:

a holding member extending in a longitudinal direction of the member to be held by a player with his or her hand;

an acceleration sensor provided held within the holding member, for detecting an acceleration sensor value;

an angular rate sensor provided held within the holding member, for detecting an angular rate sensor value of rotation of the holding member about an axis in the longitudinal direction of the holding member; and a controlling unit for obtaining a sound-generation timing based on the acceleration sensor value detected by the acceleration sensor and for giving the musical tone generating equipment an instruction of generating a musical tone, wherein the controlling unit comprises:

a sound-generation instructing unit for giving an instruction of generating a musical tone at the sound-generation timing obtained by the controlling unit;

a first rotation angle calculating unit for calculating a rotation angle of the holding member about the axis in the longitudinal direction of the holding member, based on a variation of the angular rate sensor value during a period from a starting time when the player starts swinging down motion of the holding member to a finishing time when the player finishes the swinging down motion of the holding member, wherein the starting time and the finishing time are detected based on the acceleration sensor value; and a sound volume level calculating unit for calculating a sound volume level of a musical tone to be generated, based on the rotation angle of the holding member calculated by the first rotation angle calculating unit and for giving the calculated sound volume level of a musical tone to the sound-generation instructing unit.

2. A performance apparatus used with musical tone generating equipment, the apparatus comprising:

a holding member extending in a longitudinal direction of the member to be held by a player with his or her hand;

an acceleration sensor provided held within the holding member, for detecting an acceleration sensor value;

a tri-axial magnetic sensor provided held within the holding member, for detecting magnetic sensor values, respectively, along three axes, which are in accordance with the longitudinal direction of the holding member held by the player, wherein the three axes are perpendicular to each other; and a controlling unit for obtaining a sound-generation timing based on the acceleration sensor value detected by the acceleration sensor and for giving the musical tone generating equipment an instruction of generating a musical tone, wherein the controlling unit comprises:

a sound-generation instructing unit for giving an instruction of generating a musical tone at the sound-generation timing obtained by the controlling unit;

a second rotation angle calculating unit for calculating a rotation angle of the holding member about the axis in the longitudinal direction of the holding member, based on the magnetic sensor values obtained at a starting time when the player starts swinging down motion of the holding member and the magnetic sensor values obtained at a finishing time when the player finishes the swinging down motion of the holding member, wherein the starting time and the finishing time are detected based on the acceleration sensor value; and a sound volume level calculating unit for calculating a sound volume level of a musical tone to be generated, based on the rotation angle of the holding member calculated by the second rotation angle calculating unit, and for giving the calculated sound volume level of a musical tone to the sound-generation instructing unit.

3. The performance apparatus according to claim 1, wherein the sound volume level calculating unit increases the sound volume level from a reference value when the holding member rotates about the axis in one direction, and decreases the sound volume level from the reference value when the holding member rotates about the axis in other direction.

4. The performance apparatus according to claim 3, wherein the sound volume level calculating unit calculates the sound volume level so as to increase an increasing value from the reference value as the absolute value of the rotation angle of the holding member increases, when the holding member rotates about the axis in one direction, and decreases the sound volume level so as to increase a decreasing value from the reference value as the absolute value of the rotation angle of the holding member increases, when the holding member rotates about the axis in other direction.

5. The performance apparatus according to claim 1, wherein the sound-generation instructing unit sets the sound-generation timing at the time when the acceleration sensor value detected by the acceleration sensor has decreased lower than a second threshold value after increasing larger than a first threshold value, wherein the second threshold value is lower than the first threshold value, and gives the musical tone generating equipment an instruction of generating a musical tone at the sound-generation timing.

6. The performance apparatus according to claim 5, wherein the first rotation angle calculating unit calculates a rotation angle of the holding member about the axis in the longitudinal direction of the holding member, based on a variation of the angular rate sensor value during a time which is required by the acceleration sensor value to decrease to reach the second threshold value after increasing to the first threshold value.

7. An electronic musical instrument comprising:

a performance apparatus, and a musical instrument unit including a musical tone generating unit, wherein the performance apparatus and the musical instrument unit have a communication unit, and further the performance apparatus comprises:

a holding member extending in a longitudinal direction of the member to be held by a player with his or her hand;

an acceleration sensor provided held within the holding member, for detecting an acceleration sensor value;

an angular rate sensor provided held within the holding member, for detecting an angular rate sensor value of rotation of the holding member about an axis in the longitudinal direction of the holding member; and a controlling unit for obtaining a sound-generation timing based on the acceleration sensor value detected by the acceleration sensor and for giving an instruction of generating a musical tone to the musical tone generating unit of the musical instrument unit, wherein the controlling unit comprises:

a sound-generation instructing unit for giving an instruction of generating a musical tone at the sound-generation timing obtained by the controlling unit;

a first rotation angle calculating unit for calculating a rotation angle of the holding member about the axis in the longitudinal direction of the holding member, based on a variation of the angular rate sensor value during a period from a starting time when the player starts swinging down motion of the holding member to a finishing time when the player finishes the swinging down motion of the holding member, wherein the starting time and the finishing time are detected based on the acceleration sensor value; and a sound volume level calculating unit for calculating a sound volume level of a musical tone to be generated, based on the rotation angle of the holding member calculated by the first rotation angle calculating unit and for giving the calculated sound volume level of a musical tone to the sound-generation instructing unit.

8. An electronic musical instrument comprising:

a performance apparatus and a musical instrument unit including a musical tone generating unit, wherein the performance apparatus and the musical instrument unit have a communication unit, and further the performance apparatus comprises:

a holding member extending in a longitudinal direction of the member to be held by a player with his or her hand;

an acceleration sensor provided held within the holding member, for detecting an acceleration sensor value;

a tri-axial magnetic sensor provided held within the holding member, for detecting magnetic sensor values, respectively, along three axes, which are in accordance with the longitudinal direction of the holding member held by the player, wherein the three axes are perpendicular to each other; and a controlling unit for obtaining a sound-generation timing based on the acceleration sensor value detected by the acceleration sensor and for giving an instruction of generating a musical tone to the musical tone generating unit of the musical instrument unit, wherein the controlling unit comprises:

a sound-generation instructing unit for giving an instruction of generating a musical tone at the sound-generation timing obtained by the controlling unit;

a second rotation angle calculating unit for calculating a rotation angle of the holding member about the axis in the longitudinal direction of the holding member based on the magnetic sensor values obtained at a starting time when the player starts swinging down motion of the holding member and the magnetic sensor values obtained at a finishing time when the player finishes the swinging down motion of the holding member, wherein the starting time and the finishing time are detected based on the acceleration sensor value; and a sound volume level calculating unit for calculating a sound volume level of a musical tone to be generated, based on the rotation angle of the holding member calculated by the second rotation angle calculating unit, and for giving the calculated sound volume level of a musical tone to the sound-generation instructing unit.

9. A performance apparatus used with tone generating equipment, the apparatus comprising:

a holding member extending in a longitudinal direction of the member to be held by a player with his or her hand;

an acceleration sensor provided held within the holding member, for detecting an acceleration sensor value;

an angular rate sensor provided held within the holding member, for detecting an angular rate sensor value of rotation of the holding member about an axis in the longitudinal direction of the holding member; and a controlling unit for obtaining a sound-generation timing based on the acceleration sensor value detected by the acceleration sensor and for giving the tone generating equipment an instruction of generating a tone, wherein the controlling unit comprises:

a sound-generation instructing unit for giving an instruction of generating a tone at the sound-generation timing obtained by the controlling unit;

a first rotation angle calculating unit for calculating a rotation angle of the holding member about the axis in the longitudinal direction of the holding member, based on a variation of the angular rate sensor value during a period from a starting time when the player starts swinging down motion of the holding member to a finishing time when the player finishes the swinging down motion of the holding member, wherein the starting time and the finishing time are detected based on the acceleration sensor value; and a sound volume level calculating unit for calculating a sound volume level of a musical tone to be generated, based on the rotation angle of the holding member calculated by the first rotation angle calculating unit and for giving the calculated sound volume level of a tone to the sound-generation instructing unit.

10. A performance apparatus used with tone generating equipment, the apparatus comprising:

a holding member extending in a longitudinal direction of the member to be held by a player with his or her hand;

an acceleration sensor provided held within the holding member, for detecting an acceleration sensor value;

a tri-axial magnetic sensor provided held within the holding member, for detecting magnetic sensor values, respectively, along three axes, which are in accordance with the longitudinal direction of the holding member held by the player, wherein the three axes are perpendicular to each other; and a controlling unit for obtaining a sound-generation timing based on the acceleration sensor value detected by the acceleration sensor and for giving the tone generating equipment an instruction of generating a tone, wherein the controlling unit comprises:

a sound-generation instructing unit for giving an instruction of generating a musical tone at the sound-generation timing obtained by the controlling unit;

a second rotation angle calculating unit for calculating a rotation angle of the holding member about the axis in the longitudinal direction of the holding member, based on the magnetic sensor values obtained at a starting time when the player starts swinging down motion of the holding member and the magnetic sensor values obtained at a finishing time when the player finishes the swinging down motion of the holding member, wherein the starting time and the finishing time are detected based on the acceleration sensor value; and a sound volume level calculating unit for calculating a sound volume level of a tone to be generated, based on the rotation angle of the holding member calculated by the second rotation angle calculating unit, and for giving the calculated sound volume level of a tone to the sound-generation instructing unit.

* * * * *